US007828139B2

(12) United States Patent
Enghard

(10) Patent No.: US 7,828,139 B2
(45) Date of Patent: Nov. 9, 2010

(54) CLOSURE MIXING APPARATUS FOR A DRINKING CONTAINER

(76) Inventor: Florian Enghard, Alt Schwanheim 39, Frankfurt (DE) D-60529

( * ) Notice: Subject to any disclaimer, the term of this patent is extended or adjusted under 35 U.S.C. 154(b) by 0 days.

(21) Appl. No.: 12/309,297

(22) PCT Filed: Jul. 12, 2007

(86) PCT No.: PCT/EP2007/006206

§ 371 (c)(1),
(2), (4) Date: Jan. 12, 2009

(87) PCT Pub. No.: WO2008/006592

PCT Pub. Date: Jan. 17, 2008

(65) Prior Publication Data

US 2009/0321285 A1 Dec. 31, 2009

(30) Foreign Application Priority Data

Jul. 12, 2006 (DE) ..... 10 2006 032 509

(51) Int. Cl.
*B65D 25/08* (2006.01)
*B65D 81/32* (2006.01)

(52) U.S. Cl. ..... 206/221; 426/115

(58) Field of Classification Search ..... 206/219, 206/221; 215/DIG. 8; 221/83, 87, 129, 142.5, 221/145.1; 426/115, 120, 112
See application file for complete search history.

(56) References Cited

U.S. PATENT DOCUMENTS 2,793,776 A * 5/1957 Lipari ..... 206/221
3,924,741 A * 12/1975 Kachur et al. ..... 206/221
4,315,570 A * 2/1982 Silver et al. ..... 206/221
4,513,861 A * 4/1985 Baram ..... 206/219
5,794,802 A * 8/1998 Caola ..... 206/221
5,967,309 A 10/1999 Robles-Gonzalez et al.
6,045,254 A 4/2000 Inbar et al.
6,644,471 B1 * 11/2003 Anderson ..... 206/219
6,766,903 B1 7/2004 Yehhsu
6,820,740 B1 * 11/2004 Spector ..... 206/219
6,840,373 B2 1/2005 Gibler et al.
6,886,686 B2 * 5/2005 Anderson ..... 206/219
6,962,254 B2 * 11/2005 Spector ..... 206/222
7,172,095 B2 * 2/2007 Marshall ..... 206/219
7,503,453 B2 * 3/2009 Cronin et al. ..... 206/221

(Continued)

FOREIGN PATENT DOCUMENTS

DE 2 339 388 2/1975

(Continued)

*Primary Examiner*—Bryon P Gehman
(74) *Attorney, Agent, or Firm*—W. F. Fasse; W. G. Fasse

(57) ABSTRACT

A closure apparatus is fitted onto a container opening of a drinking container with an inner space for reception of a drinking liquid. The closure apparatus includes a chamber body that defines therein a receiving chamber, the content of which is introducible into the inner space of the drinking container. The closure apparatus further includes a closure element that selectively closes a first opening of the chamber body, and an axially slidably displaceable cover element that selectively closes a second introduction opening of the chamber body. The content of the receiving chamber is releasable into the inner space of the drinking container through the second introduction opening by an axial sliding displacement of the cover element.

18 Claims, 1 Drawing Sheet

U.S. PATENT DOCUMENTS

| | | | | |
|---|---|---|---|---|
| 2004/0007481 | A1 | 1/2004 | Kiser, Jr. | |
| 2005/0126632 | A1 | 6/2005 | Farrell et al. | |
| 2005/0150902 | A1 | 7/2005 | Cho | |
| 2006/0118435 | A1 | 6/2006 | Cronin et al. | |
| 2009/0223921 | A1 | 9/2009 | Enghard | |
| 2010/0059394 | A1 * | 3/2010 | Fontana | 206/219 |

FOREIGN PATENT DOCUMENTS

| | | |
|---|---|---|
| DE | 296 20 767 | 2/1998 |
| DE | 298 01 519 | 4/1998 |
| DE | 103 41 112 | 3/2005 |
| DE | 202006009805 | 8/2006 |
| EP | 0 520 616 | 12/1992 |
| GB | 440661 | 1/1936 |
| GB | 477 922 | 1/1938 |
| GB | 1 436 648 | 5/1976 |
| WO | WO 01/25099 | 4/2001 |
| WO | WO 2006/034162 | 3/2006 |
| WO | WO 2006/097823 | 9/2006 |

* cited by examiner

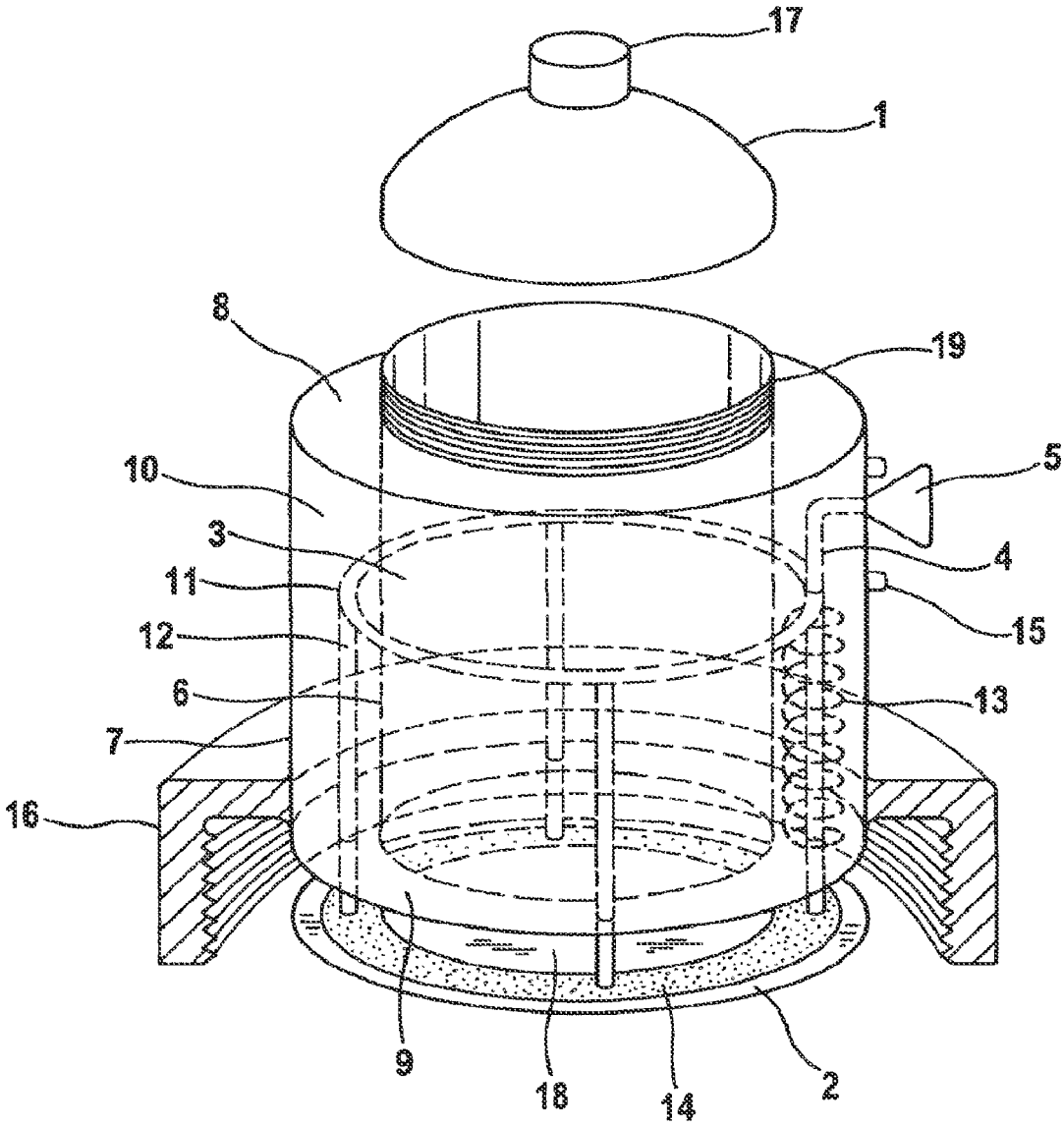
17
1
8
19
10
5
3
4
11
15
12
6
13
7
16
9
18
14
2

CLOSURE MIXING APPARATUS FOR A DRINKING CONTAINER

FIELD OF THE INVENTION

The invention relates to a closure apparatus for a drinking container. The closure apparatus includes a receiving chamber, from which the contents thereof may be released into the drinking container.

BACKGROUND INFORMATION

At the present time, there are many nutritional compositions that are to be consumed especially before or during athletic activities. These shall especially serve to improve the performance capability or to supply important nutritional components. These nutritional compositions mostly consist of an aqueous drinking solution and a solid or powder-form nutritional supplement substance, that are admixed with one another and consumed in a drinking container. Especially with regard to isotonic nutritional compositions, there are also already isotonic finished prepared drinks or beverages, for which the beverage bottler has already added the powder-form isotonic supplement substances to an aqueous solution, and which can be consumed on the spot as a finished prepared beverage from a concurrently distributed drinking container.

Such finished prepared beverages in the mixed state, however, often lose taste or effectiveness so that it is necessary to admix one or more dietary supplement substances into the drinking solution only on location shortly before consumption. For that purpose, the dietary supplement substances are usually supplied in powder form or as a solid substance in a soluble tablet form and are manually admixed with a potable drinking water or mineral water. This is very complicated or cumbersome especially in connection with athletic activity or at sport-related places of use, and requires separately bringing along a container of potable drinking water, a container with the dietary supplement substances as well as a separate drinking container for mixing and drinking the prepared beverage.

From the DE 103 41 112 A1, there is already known a container with a separate storage or reservoir chamber through which a pre-dosed quantity of a dietary supplement substance can be admixed into an aqueous solution shortly before consumption. For that purpose, a main container for receiving a first substance is provided, which consists of a base surface and a side wall that surrounds the base surface and comprises a container opening at the top thereof. For air-tight closure, a lid or cap element with integrated storage chamber is arranged into the container opening, wherein the storage chamber is partially screwed onto the main container over an external threading of the bottle neck. The storage chamber consists of solid insert parts, that comprise a cylinder-shaped sleeve and a closing or sealing cap and are closed at the bottom by a solid tight film. Apparently solid, powder-form or gas-form dietary supplement substances can be accommodated as a second substance in this storage chamber. Additionally, further a compression body is set into the lid or cap element, and downwardly comprises a cutting blade section, which cuts through the film due to a pressing force from above and thus introduces the second substance into the first substance of the main container, which is then admixable therewith as a finished prepared beverage. Such receiving or storage chambers separated by films are basically only suitable for one-time use, or are again sealable only in a complicated or cumbersome manner, so that this is contrary to a repeated re-use. But even with a one-time use, rest pieces of film can get into the beverage, so that it is sensible to pour-over or transfer this mixture through a sieving process into a separate drinking container.

SUMMARY OF THE INVENTION

It is therefore the underlying object of the invention to provide a closure apparatus for a drinking container with which dietary supplement components are admixable into a drinking substance in a short time, and which is simple to handle, and through which absolutely no contaminants can get into the finished prepared drink or beverage.

The above object has been achieved according to the invention in a closure apparatus for a drinking container. The closure apparatus includes a chamber body that defines a receiving chamber therein and that has a first opening and a second opening at opposite ends thereof. The closure apparatus further includes a closure cap that selectively closes the first opening, and a cover element that selectively closes the second opening. The cover element is axially slidably displaceable relative to the chamber body so as to selectively open or close the second opening with the cover element. When the cover element uncovers or opens the second opening, then the content of the receiving chamber can be released through the second opening into the inner space of the drinking container.

The invention has the advantage that even unstable drink or beverage mixtures can be prepared by mixing plural components with one another in a simple manner at any time and at any location shortly before the consumption, and can be immediately consumed out of the drinking container, due to the closure apparatus with an integrated receiving chamber for additional nutritional substances. This can be achieved in a simple manner by a simply-operable sliding displacement process, without requiring separating walls or separating films to be pierced through with a great application of force.

Such a closure apparatus also has the advantage that it consists only of a few simple easily-producible parts, that can be produced economically also as synthetic plastic injection molded parts in series production. For that purpose, simply a container bottle and the closure apparatus is necessary, whereby advantageously the hollow space of the closure apparatus simultaneously forms the receiving chamber for the dietary supplement substances, which through an addition or introduction opening in the bottom part automatically effectuates the emptying into the interior space of the drinking container by a sliding displacement process, and thereby introduces or begins the mixing process.

Also advantageously, no separating substance can be damaged by the invention, so that such a receiving chamber, after the use, is again fillable at any time and thus can be used again by the user himself. Due to the sliding closure, the closure apparatus can also be quickly disassembled or broken-down into its few component parts through complete removal and disassembly of the closure apparatus, which component parts are then advantageously easy to clean for the reuse.

In a particular embodiment of the closure apparatus according to the invention, simultaneously a closeable mouthpiece is arranged on the upper closure element, through which mouthpiece the drinking liquid can be drunk immediately after the mixing process without further measures, and which also is again useable for the renewed filling-in of a dietary supplement substance. In that regard it can advantageously involve powder-form, liquid or soluble solid dietary supplement substances, which can be dosed nearly as desired.

BRIEF DESCRIPTION OF THE DRAWING

The invention will now be explained more closely in connection with an example embodiment, which is shown in a partially sectioned perspective view in the single FIGURE of the drawing.

DETAILED DESCRIPTION OF AN EXAMPLE EMBODIMENT OF THE INVENTION

A closure apparatus for a drinking container is illustrated in the drawing. In that regard, the closure apparatus essentially consists of an upper closure element 1 and a lower axially slidably displaceable cover element 2 and a receiving chamber 3 arranged therebetween, whereby the lower cover element 2 is connected with an operating device 4, by which the cover element 2 is axially slidably displaceable from the outside via an operating element 5.

The closure apparatus is provided in order to close a drinking bottle in its bottle neck piece, and simultaneously to ensure or enable the addition or introduction of a dietary supplement substance out of the integrated receiving chamber 3. For that purpose, the closure apparatus includes the receiving chamber 3 between the upper closure element 1 and the lower cover element 2, wherein the receiving chamber 3 is essentially formed by an inner pipe stub 6. This receiving chamber 3 is closed in an air-tight manner by the upper closure element 1 and the lower cover element 2.

Additionally an outer pipe stub 7 is arranged coaxially around the inner pipe stub 6, wherein the outer pipe stub 7 is connected with the inner pipe stub 6 by an upper 8 and a lower ring element 9. In that regard, a ring-shaped or annular hollow space 10 is left to remain between the two pipe stubs 6,7, in which hollow space the operating device 4 for the axial sliding displacement of the lower cover element 2 is arranged.

The operating device 4 includes a sliding ring 11 that is guided in the hollow space 10, and that is connected via preferably four connecting rods 12 as connecting elements with the lower cover element 2. A compression spring 13 is arranged around at least one connecting rod 12, which compression spring presses the sliding ring 11 axially upwardly in the non-operated state, so that the lower cover element 2 tightly lies against or contacts on the lower ring element 9 and thereby closes the receiving chamber 3. In that regard, the lower cover element 2 is preferably embodied as a flat round disk, which can also comprise a cone-shaped structure toward the top. For better sealing, still further a seal element 14 is secured on the contact surface of the lower cover element 2. The seal element 14 is preferably fabricated of a taste-neutral seal material, which, for example, represents a rubber seal ring or a synthetic plastic. seal ring.

An operating element 5 is connected in a force-transmitting manner with the sliding ring 11 or at least one connecting rod 12, whereby the operating element is led to the outside via an axial slot or slit in the outer pipe stub 7. In that regard, the operating element 5 is preferably embodied as a radially bent or kinked flat sliding displacement handle, which serves for the manual axial sliding displacement of the sliding ring 11 arranged in the hollow space 10, whereby the receiving chamber 3 is releasable or openable to the inner space of the drinking container by the sliding ring. The operating device 4 can be embodied as a synthetic plastic injection molded part, or plural parts which are welded together with one another during the fabrication, or is assembled or joined of individual parts. In that regard, the operating element 5 can also be embodied as a lever arm, which is braced against the sliding ring 11 via a hinge joint part, via which the lever arm can axially slidingly displace the sliding ring. The operating element 5 can, however, also be embodied as a radial pivot lever, which is in engagement with the sliding ring 11 via a sloping or slanted slot element and thereby axially slidingly displaces the sliding ring 11 that is supported on a spring.

The operating element 5 is preferably glidingly guided over one or two fixing ribs 15, which fix the operating device 4 in one or more opening positions. For better assembly, the outer pipe stub 7 can also be embodied in two parts, which is snapped together or screwed together with one another after the assembly of the operating device 4. In that regard, all parts preferably consist of synthetic plastics, which can be produced easily and economically as synthetic plastic injection molded parts.

For the connection of the closure apparatus with the drinking container, still further a connecting ring 16 is secured on the outer pipe stub 7. While the rest of the drawing FIGURE is shown in perspective with some dashed ghost lines depicting hidden parts, the connecting ring 16 is shown in perspective but sectioned on a vertical plane along the axis of the closure apparatus, for the sake of clarity and simplicity. The connecting ring 16 preferably comprises an internal threading that can be screwed onto an external threading of a drinking bottle. The connecting ring 16 could, however, also be embodied on the inside as a concave ring element which can be snapped onto a convex round rim of a drinking container. However, nonetheless, also an external threading could be formed on the outer pipe stub 7 at least in the bottom region, which external threading can then be screwed into a drinking container with internal threading.

For closing the receiving chamber 3, in the upper region the inner pipe stub 6 is led out at least 5 mm over the upper ring element 8 and provided with an external threading 19 or a ring web or land or a ring groove. Then, the upper closure element 1, which is embodied respectively with an internal threading or a ring groove or a ring web or land is screwable or snapable onto the external threading 19, in order to close the receiving chamber 3 in an air-tight manner. The upper closure element 1 is embodied cap or lid-shaped preferably as a round cap or lid with a central outlet opening or a mouth piece 17. In that regard, preferably a closeable mouth piece 17 is formed onto the upper closure element 1, through which mouthpiece the content of the drinking bottle can be directly consumed. In that regard, for the closing, preferably a formed-on closure cap is provided, which is snapped-on over a round rim of the mouthpiece 17.

In the assembled non-operated state, the lower cover element 2 lies tightly in contact on the lower ring element 9 by at least one compression spring 13, and thereby closes the receiving chamber 3 relative to the drinking bottle inner space, into which preferably a watery or aqueous drinking liquid is filled, into which the provided dietary supplement substance out of the receiving chamber 3 is to be mixed-in. For that purpose, the dietary supplement substance in a provided quantity can previously be filled into the receiving chamber 3 through the opened upper closure element 1, and this again be closed. When needed, then the operating element 5 is axially slidingly displaced downwardly against the spring force of the compression spring 13, so that the lower cover element 2 is slidingly displaced axially downwardly by the operating device 4. Thereby, the lower cover element 2 opens the receiving chamber 3 via an annular gap 18 as an introduction or addition opening, through which the dietary supplement substance is dosed into the drinking liquid and is mixable therewith. With an opened annular gap 18, then the mixed drinking liquid can be drunk through the receiving chamber 3 and the opened mouthpiece 17. It is, however, also possible to produce an embodiment of the closure apparatus, in which the thin pipe-shaped mouthpiece 17 is led in a sealed manner through the lower cover element 2 into the inner space of the drinking container. Then a drinking process is also possible with an opened mouthpiece 17 and closed receiving chamber 3.

The invention claimed is:

1. A closure device for a drinking container that has a container opening communicating into a container inner space which is adapted to receive a drinking liquid therein, wherein said closure device is adapted to selectively close and open the container opening, and said closure device comprises:

a chamber body defining an axis and including an inner wall, an outer wall, and first and second openings respectively at first and second opposite ends of said chamber body, wherein said inner wall bounds a receiving chamber therein, said outer wall coaxially surrounds said inner wall about said axis of said chamber body and said outer wall is spaced apart from said inner wall to form an annular space between said inner and outer walls, and said first and second openings respectively communicate into said receiving chamber at said opposite ends of said chamber body;

a closure element that is attached or attachable to said chamber body and that selectively opens and closes said first opening;

a cover element that is axially displaceable relative to said chamber body in an axial direction by an axial sliding motion along said axis to selectively open and close said second opening;

an operating arrangement including a sliding ring that is axially slidably displaceable in said axial direction within said annular space, and plural connecting elements that connect said sliding ring with said cover element; and a manually operable operating element that is connected to said operating arrangement and extends outwardly through an opening in said outer wall.

2. The closure device according to claim 1, wherein said connecting elements are rods extending in said axial direction, and wherein a respective first end of each one of said rods is connected to said sliding ring and a respective second end of each one of said rods is connected to said cover element so that said cover element, said rods and said sliding ring are axially displaceable together as a unit relative to said chamber body by said axial sliding motion in said axial direction.

3. The closure device according to claim 2, wherein said rods extend in said axial direction in said annular space.

4. The closure device according to claim 1, wherein said operating element is connected to said sliding ring.

5. The closure device according to claim 1, wherein said opening in said outer wall through which said manually operable operating element extends is an axial slot or slit.

6. The closure device according to claim 1, further comprising a spring that is arranged in said annular space and that acts on said operating arrangement to axially bias said operating arrangement with respect to said axial direction.

7. The closure device according to claim 6, wherein said spring biases said operating arrangement to move said cover element toward said chamber body.

8. The closure device according to claim 1, wherein said chamber body further includes a first ring element and a second ring element that connect said inner wall with said outer wall respectively at said first and second opposite ends of said chamber body, and that bound said annular space in said axial direction.

9. The closure device according to claim 8, wherein said connecting elements extend and are slidably displaceable through said second ring element.

10. The closure device according to claim 1, further comprising fixing ribs on said outer wall, which guide and fix an axial sliding motion of said manually operable operating element.

11. The closure device according to claim 1, wherein said cover element comprises a round disk and a seal element arranged on an inner surface of said round disk.

12. The closure device according to claim 1, further comprising an internally threaded ring that is connected externally onto said outer wall and that is adapted to be screwed onto an externally threaded neck bounding the container opening of the drinking container.

13. The closure device according to claim 1, wherein said outer wall has an external threading that is adapted to be screwed into an internal threading of the drinking container bounding the container opening.

14. The closure device according to claim 1, wherein said closure element is a closure cap that has one of an internal threading, a ring land or a ring groove configured and dimensioned to be releasably attachable to a mating portion of said inner wall.

15. The closure device according to claim 1, wherein said closure element has a central outlet opening therein, and a cap or a closeable mouthpiece arranged thereon to selectively open or close said central outlet opening.

16. A combination comprising said closure device according to claim 1, and a beverage supplement substance contained in said receiving chamber.

17. The combination according to claim 1, further comprising the drinking container, wherein said closure device is releasably connected to said drinking container so as to selectively open and close said container opening via a passage through said first opening, said receiving chamber and said second opening of said closure device into said container inner space.

18. The combination according to claim 17, further comprising a drinking liquid contained in said container inner space, wherein said closure device is adapted to release said beverage supplement substance into said drinking liquid through said second opening by manual operation of said operating element that is adapted to axially displace said cover element away from said second end of said chamber body by said axial sliding motion to thereby open said second opening.

* * * * *

UNITED STATES PATENT AND TRADEMARK OFFICE

CERTIFICATE OF CORRECTION

PATENT NO. : 7,828,139 B2
APPLICATION NO. : 12/309297
DATED : November 9, 2010
INVENTOR(S) : Florian Enghard It is certified that error appears in the above-identified patent and that said Letters Patent is hereby corrected as shown below:

Column 3,
Line 54, after "plastic", delete ".";

Column 6,
Line 43, claim 16, after "claim", replace "1" by --16--.

Signed and Sealed this
Twenty-fourth Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,828,139 B2
APPLICATION NO. : 12/309297
DATED : November 9, 2010
INVENTOR(S) : Florian Enghard It is certified that error appears in the above-identified patent and that said Letters Patent is hereby corrected as shown below:

Column 3,
Line 54, after "plastic", delete ".";

Column 6,
Line 43, claim 17, after "claim", replace "1" by --16--.

This certificate supersedes the Certificate of Correction issued April 24, 2012.

Signed and Sealed this
Twenty-sixth Day of June, 2012

David J. Kappos

David J. Kappos
*Director of the United States Patent and Trademark Office*